US007654684B1

(12) United States Patent
Wight et al.

(10) Patent No.: US 7,654,684 B1
(45) Date of Patent: Feb. 2, 2010

(54) SOLAR-RECHARGEABLE LIGHT

(76) Inventors: Robert M. Wight, 1922 E. Wastch Blvd., Sandy, UT (US) 84092; James A. Rohbock, 2879 E. 9800 S., Sandy, UT (US) 84092; Darren C. Ashby, 144 S. State St., Richmond, UT (US) 84333

( * ) Notice: Subject to any disclaimer, the term of this patent is extended or adjusted under 35 U.S.C. 154(b) by 0 days.

(21) Appl. No.: 11/395,551

(22) Filed: Mar. 31, 2006

Related U.S. Application Data

(60) Provisional application No. 60/667,607, filed on Apr. 1, 2005.

(51) Int. Cl.
*F21L 13/00* (2006.01)

(52) U.S. Cl. ..... 362/183; 362/191; 362/431; 362/812

(58) Field of Classification Search ..... 362/183, 362/191, 431, 812; 40/563
See application file for complete search history.

(56) References Cited

U.S. PATENT DOCUMENTS

| | | | | |
|---|---|---|---|---|
| 5,101,329 | A * | 3/1992 | Doyle | 362/183 |
| 5,729,924 | A * | 3/1998 | Reading | 40/564 |
| 6,604,840 | B2 * | 8/2003 | Watson | 362/249 |
| 6,900,735 | B2 * | 5/2005 | Guerrieri et al. | 340/815.4 |

* cited by examiner

*Primary Examiner*—Anabel M Ton
(74) *Attorney, Agent, or Firm*—Brian C. Trask

(57) ABSTRACT

A solar-rechargeable light fixture. A preferred embodiment is adapted for attachment to the horizontal cross-bar of a yard-mounted real estate sign effective to illuminate both sides of the sign after dark. The light fixture includes a solar panel adapted to charge a battery which powers a plurality of lights, such as incandescent bulbs or LEDs. Sometimes, a microprocessor is included in-circuit to control operation of the light fixture, and may also provide diagnostic feedback to a user. Desirably, the light fixture can be switched into a storage mode to avoid discharge of the battery during periods of non-use.

1 Claim, 8 Drawing Sheets

SOLAR-RECHARGEABLE LIGHT

RELATED APPLICATIONS

This application claims the benefit under 35 U.S.C. 119(e) of the filing date of Provisional Application Ser. No. 60/667,607, filed Apr. 1, 2005, for "SOLAR RECHARGEABLE LIGHT", the entire disclosure of which is hereby incorporated as though set forth herein.

BACKGROUND

1. Field of the Invention

This invention relates to apparatus operable to produce humanly visible light responsive to a low-light environment. In particular, the invention relates to electrically powered, solar-rechargeable, visible light-producing structures.

2. State of the Art

Lighting is known that is adapted to illuminate a single-sided display sign, such as a billboard. Such lighting generally includes one or more lamp in a light fixture that is typically hard-wired into electrical power delivered from an electrical utility. Therefore, placement of a display sign such as a billboard is limited by the proximity of, and ability to make a connection to, an electrical utility source. The light fixture associated with a billboard is typically anchored in a substantially permanent association with that billboard. Furthermore, only a single side of the billboard is illuminated by the light fixture.

It would be an improvement in the art to provide a light fixture that is capable of illuminating both sides of a two-sided display sign. A further improvement would provide a solar-rechargeable, battery-powered light fixture adapted to illuminate both sides of a two-sided sign. Another improvement would provide a portable light fixture adapted to illuminate both sides of a two-sided sign that can be moved from a first sign to a second sign. It would also be an improvement to provide a battery-powered light fixture adapted to illuminate both sides of a two-sided sign that includes an override switch to enable storage of the light fixture in a dark environment in a charged condition without causing a light emission. A still further improvement would provide a solar-rechargeable light fixture that includes a microprocessor to manage battery life and/or illumination output, or to control other operations of the light fixture.

BRIEF SUMMARY OF THE INVENTION

The present invention provides a solar-rechargeable light fixture adapted to be recharged by the sun during the day, and to emit light for a period of time after dusk. Embodiments of the invention may be arranged to provide 8 to 12 hours, or even more in certain cases, of additional time during a 24-hour day in which a sign may be visually observed. An exemplary embodiment of the invention provides a solar-rechargeable light fixture that is configured and arranged to illuminate both sides of a residential, yard-mounted, real estate sign. The exemplary embodiment may be used to extend the period of time during which a real estate sign is visible to potential clients. The illuminated real estate sign provides an eye-catching attraction after dark to passers-by.

The invention may be embodied as a solar-rechargeable light fixture including a microprocessor disposed in-circuit with a light-emitting element operably to control an illumination output of the light fixture. The microprocessor is typically installed in-circuit as one portion of electric control circuitry structured to receive a first input and to control certain operations of the light fixture based upon that input. In certain cases, a control-receiving device is disposed in-circuit to permit an input to the microprocessor. Such input can include environmental or operational feedback, or programming instructions. Sometimes, the electric control circuitry may include elements configured and arranged to provide a substantially constant current source to the first light-emitting element for a first extended period of time to cause an approximately uniform illuminational discharge from the first light-emitting element during the first extended period of time.

In certain cases, the light fixture is adapted to provide illumination to a surface area. One such light fixture includes a housing structured for anchoring in proximity to the surface area. A first electrically powered, light-emitting element is disposed operably in association with the housing to cast illumination upon the surface.

Preferably, a charging device adapted to convert radiation to electrical energy is associated with the housing operably to expose the charging device to radiation from the sun. In such case, a rechargeable energy storage device, such as a battery pack, is disposed in association with the housing to permit electrical communication between the energy storage device and the charging device to urge the energy storage device toward an electrically charged condition, and to permit electrical communication between the energy storage device and the first light-emitting element to provide a portion of illumination.

Certain embodiments include a sensor disposed in-circuit effective to interrupt electrical communication between the energy storage device and the first light-emitting element during periods of illumination that are above a threshold value in the vicinity of the sensor. A sensor may be embodied as a photoelectric eye, or a workable combination of elements such as the solar panel and microprocessor.

Also, certain embodiments may include an override switch operable by a user to interrupt electrical communication between the first light-emitting element and the energy storage device to permit storage of the light fixture in an electrically charged condition in a low-light environment without causing operation of the first light-emitting element. One operable override switch is of the type that is structured for adjustment between a plurality of control positions by action of a human hand. Another workable override switch may embodied as a magnetic pick-up device, such as a Hall-effect sensor, disposed in-circuit to cause an input to the microprocessor responsive to user operation of a magnetic key.

Certain currently preferred embodiments structured according to principles of the invention include both first and second electrically powered, light-emitting elements disposed operably in association with the housing. In such case the first light-emitting element and the second light-emitting element desirably are spaced apart to permit straddled anchoring disposition of the housing with respect to a two-sided sign such that the first light-emitting element may cast illumination upon a portion of the first side of the two-sided-sign and the second light-emitting element may cast illumination upon a portion of the second side of the two-sided sign. In such case, the housing may be structured for anchoring to a crossbar of a real estate sign in a straddling position effective to orient the first light-emitting element on one side of a placard suspended from the cross-bar, and to orient the second light-emitting element on the opposite side of the placard.

In one currently preferred light fixture, the microprocessor is programmed to cause a delay for a first period of time, subsequent to an output from the charging device falling below a charge threshold value, before permitting electrical communication from the energy storage device to the first light-emitting element. Sometimes, such first period of time is programmable. Further, subsequent to permitting electrical communication between the energy storage device and the first light-emitting element, the microprocessor may be programmed to cause a delay for a second period of time before turning off the light, to ensure that a rise in the output from the charging device above the charge threshold value is not caused by a source of stray light. It is currently preferred for the microprocessor, upon receipt of a corresponding user command input, to perform a self-diagnostic circuitry test for the light fixture and to cause a humanly perceptible output indicative of the results of the diagnostic test.

As an energy management scheme, the microprocessor may be programmed to cause a first approximately uniform and sub-maximum electrical output, from the energy storage device to the first light-emitting element, which is effective to maintain effective illumination brightness of an output from the first light-emitting element at a first substantially uniform value, during a first extended period of time during which a reduction of energy stored in the energy storage device occurs. Also, the microprocessor can be programmed to cause a second approximately uniform and sub-maximum electrical output, from the energy storage device to the first light-emitting element, which is effective to maintain effective illumination brightness of an output from the first light-emitting element at a second substantially uniform value, during a second extended period of time during which a further reduction of energy stored in the energy storage device occurs.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
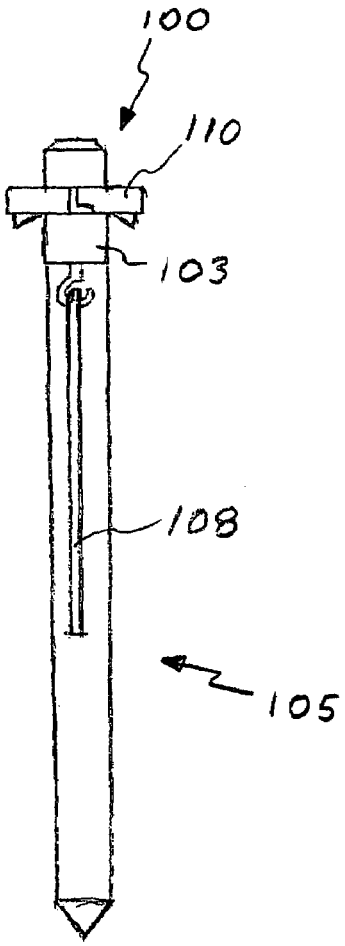
FIG. 1 is a front view in elevation of one currently preferred embodiment of the invention installed on a commercially available real estate yard sign.
Figure 2:
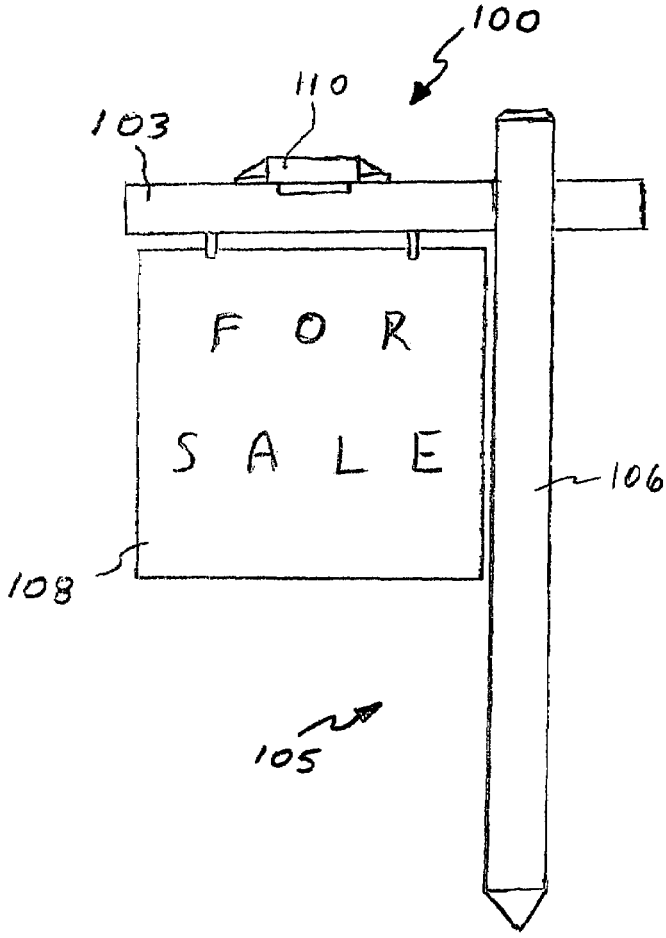
FIG. 2 is a side view in elevation of the assembly illustrated in FIG. 1.
Figure 3:
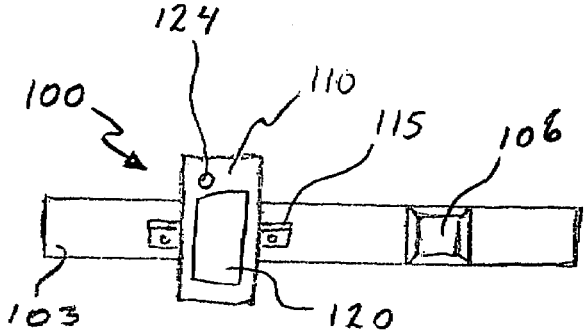
FIG. 3 is a top view of the assembly illustrated in FIG. 1.

A first embodiment of a light fixture structured according to principles of the invention is illustrated in FIGS. 1-3, and is generally indicated at 100. Light fixture 100 is adapted for anchoring to a cross-bar 103 of a commercially available real estate sign, generally indicated at 105. The illustrated real estate sign 105 is representative of the residential yard-mounted type, and includes a vertical member 106 and cross-bar 103, which are typically made from dimensional lumber, such as wooden posts having a 4-inch by 4-inch cross-section. In the illustrated anchored position, light fixture 100 is capable of illuminating at least a portion of the surface area on each side of the two-sided sign or placard 108 that hangs from the cross-bar 103. Of course, it is to be realized that light fixtures within the ambit of the instant invention may be anchored to other structure associated with a sign, and may be used in conjunction with signs and/or sign-suspending structure having alternative construction to that illustrated.

Light fixture 100 includes a housing 110 adapted for attachment to cross-bar 103. As illustrated, one convenient anchoring arrangement includes one or more flange 115 through which a fastener may be installed for engagement with cross-bar 103. It is currently preferred to use fasteners that are not commonly available, or that are structured for installation only, to provide a measure of vandal resistance and theft deterrence. Fasteners of the type that interface with a tool to permit installation but resist removal are currently preferred. Less common fastener types, such as Torx™ fasteners are also preferred. Fasteners requiring special and/or unusual tools to remove are also preferred. However, other fasteners, including commonly available lag bolts, machine bolts, wood screws, nails, and the like, are also operable.

In certain desirable embodiments, a light fixture, such as illustrated light fixture 100, may be structured as a portable device to permit its removal from association with one sign, and subsequent installation in association with a different sign. Alternative mounting arrangements are within contemplation, including mounting arrangements adapted to permit a tool-free installation of a light fixture onto a cooperatively structured mounting surface. Logically, light fixtures adapted to illuminate a single-sided object would have an appropriately structured alternative anchor arrangement.

With continued reference to FIGS. 1-3, housing 110 is disposed in a straddled anchor position to extend over both sides of the cross-bar 103 to space light-emitting elements operably to illuminate a portion of each of the two sides of the sign 108. The illustrated light fixture 100 overhangs the cross-bar 103 by approximately 2 inches, although any reasonable and operable overhang may be, provided in alternative embodiments. The light fixture 100 may also be positioned in other locations with respect to a sign, although the preferred illustrated top-mounting position aides in shielding the light source from observers, and helps to resist water penetration into the light housing 110.

Of course, it must be realized that certain embodiments of the invention may alternatively find application in illuminating a single side of an object. Furthermore, a workable anchoring arrangement may include one or more intermediate adapter elements structured to form a connection between a sign, the ground in the vicinity of a sign, or sign-suspension structure such as a sign post, and a housing of a light fixture constructed according to principles of the invention. Certain alternative anchoring arrangements may suspend a light fixture directly from a sign, or from any other convenient structure.

Also, housings may be substantially rectangular, as illustrated, or may be alternatively shaped. It is within contemplation for a housing 110 to have either of a plan form or a cross-section having a round, elliptical, oval, or other alternative geometric shape. Operable housings 110 may be manufactured from plastic, metal, or other structural materials. A currently preferred material from which to make a housing 110 includes high impact, light weight, durable plastic that may be injection molded. The housing 110 typically provides a water resistant enclosure in which to hold components including one or more light-emitting elements, and a rechargeable energy storage device, such as a battery. A housing 110 may have a length "L", a width "W", and a depth "D" (see FIG. 5), that are sized as appropriate for a given application. In one currently preferred embodiment, the length L is about 8 inches, width W is about 3 inches, and the depth D is about 1 inch.

With reference now to FIG. 3, the housing 110 desirably provides an anchoring foundation that is structured to hold an electric charging device, such as solar panel 120, in position to collect solar energy during daylight hours. The illustrated solar panel 120 converts solar radiation into electrical energy, and is generally placed in-circuit with a rechargeable energy storage device, such as one or more battery. A currently preferred solar panel has an output of about 140 mA at 5V, although other solar panels are operable. In general, the output of an operable solar panel is matched to electrical characteristics of the battery pack.

A photoelectric eye 124 may be included in certain embodiments of a light fixture 100. Such photoelectric eyes are well known and commercially available. As illustrated in FIG. 3, the photoelectric eye 124 is desirably carried by the housing in a position operable to sample the ambient light level. When present, photoelectric eye 124 is typically installed in-circuit to function as a control switch effective to automatically turn the light source off during sun-lit intervals, and to permit the light fixture 100 to generate illumination during periods of low ambient light.

Figure 4:
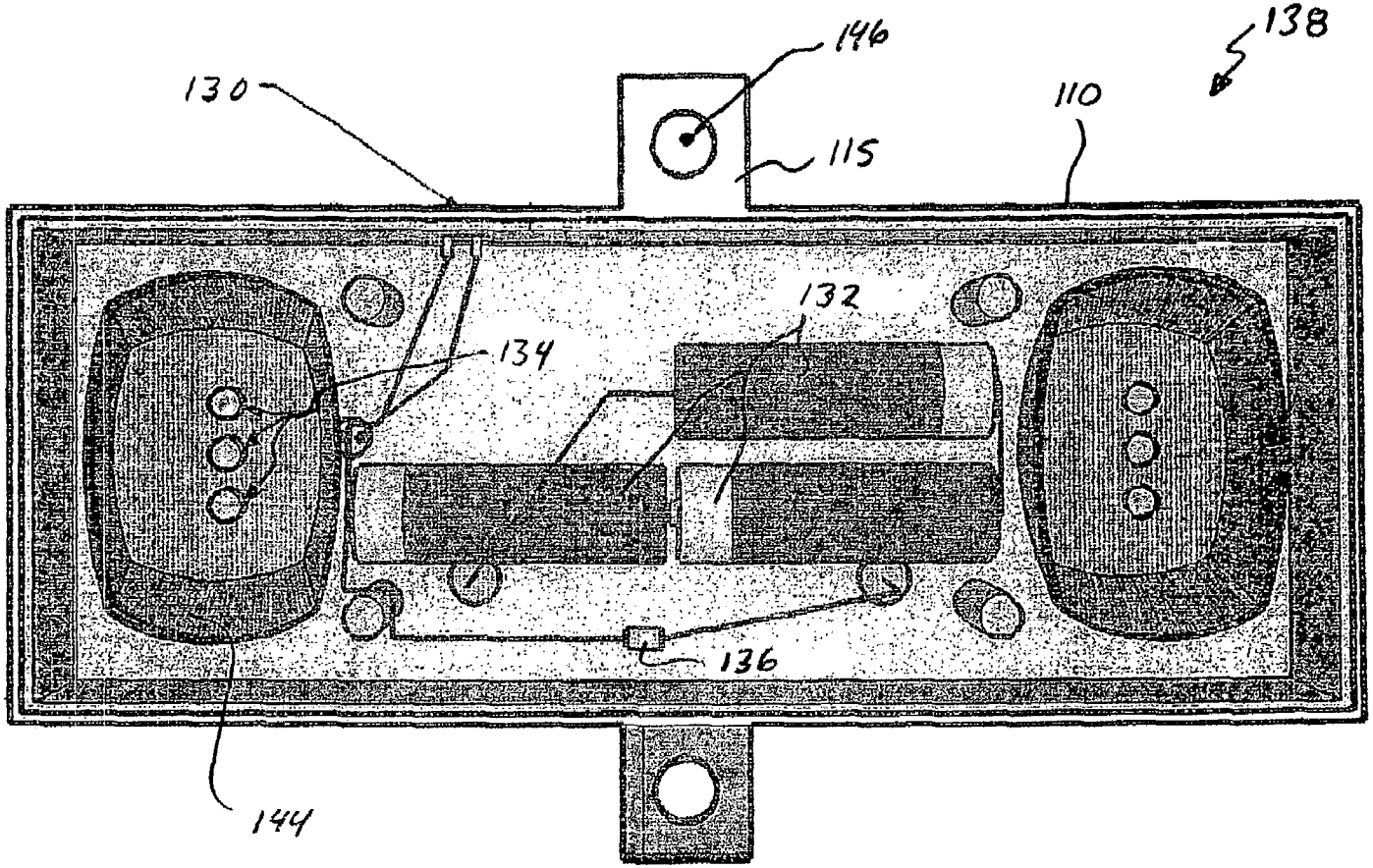
FIG. 4 is a bottom view of a light fixture constructed according to certain principles of the invention.
Figure 5:
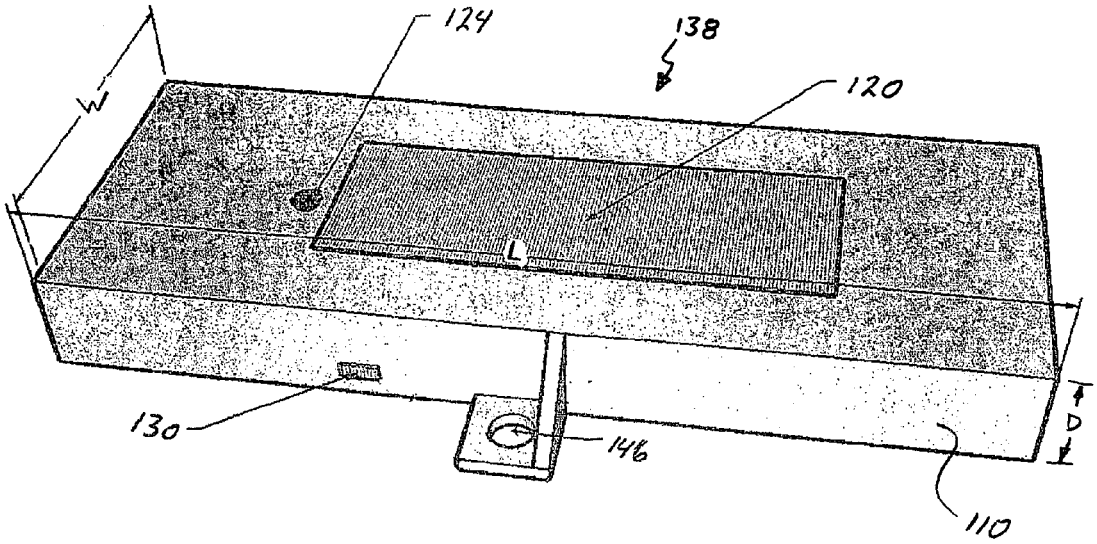
FIG. 5 is a front view in perspective of the light fixture illustrated in FIG. 4.

An optional by-pass switch, or override switch, may be provided to permit a user to turn a light fixture off, when desired, and even during periods of darkness. The by-pass switch 130 illustrated in FIGS. 4 and 5 provides one embodiment of a manually operated structure effective to interrupt electrical communication between the energy storage device and the light emitting element(s). Desirably, a by-pass switch, such as switch 130, may be actuated to place a light fixture 100 into a "sleep" or storage mode when storing one or more light fixture assemblies in a dark room without causing depletion of the energy storage device.

With reference to FIG. 4, it is desirable for the housing 110 to hold one or more rechargeable batteries 132 arranged to form a battery pack. An operable battery 132 includes a long-life battery, such as a battery based upon an alkaline chemical reaction. However, it is currently preferred to employ one or more battery that employs a chemical reaction with properties similar to Nickle-Cadmium or Nickle-Metal-Hydride to provide robust recharging life. One or more operable batteries can be selected from battery types nonexclusively including NiCad, NhMi, Lithium, lead-acid, and Alkaline. The operational characteristics of a battery pack will, of course, be selected in harmony with an output of solar panel 120.

The battery 132, or battery pack, is placed in-circuit with the solar panel 120 to provide electrical power to one or more light-emitting elements 134. As illustrated in FIG. 4, a resistor 136 may be placed in-circuit to provide for recharging the battery 132. The wiring configuration illustrated in FIG. 4 provides a hard-wired control circuit effective to recharge the battery 132 during periods of sufficient local solar radiation, and in conjunction with a circuit-interruption device such as photoelectric eye 124, to control periods during which illumination is generated by the light fixture 138.

An operable light-emitting element 134 includes one or more of: a Light Emitting Diode (LED), incandescent bulb, fluorescent tube, or other electrically powered element operable to produce visible light. In any case, the operational characteristics of a light-emitting element 134 will be selected in harmony with an output of a battery pack and associated circuitry. It is currently preferred to use a commercially available LED as a light-emitting source, because such LED devices are efficient in converting electricity to visible light, and due to their inherent long life.

Sometimes, a reflector 144 may also be provided in a light fixture, such as light fixture 138 illustrated in FIG. 4, to help shape a pattern and intensity of illumination cast by the light fixture upon a sign or placard. It is within contemplation for the light-emitting element(s) to directly provide such illumination shaping without requiring a reflector 144.

The override switch 130 illustrated in FIGS. 4 and 5 is the type of switch that a user's finger may slide between "on" and "off" positions. It is also within contemplation for the bypass switch 130 to be structured for automatic actuation during an installation procedure. One example of such an automatic switch 130 includes a normally open contact that is maintained in a closed position (e.g. by a fastener installed in bolt hole 146 and used to anchor the light fixture to a mounting surface). In such case, removing the light fixture 100 from a sign automatically would interrupt the electric circuit to prevent the light source from being energized.

Figure 6:
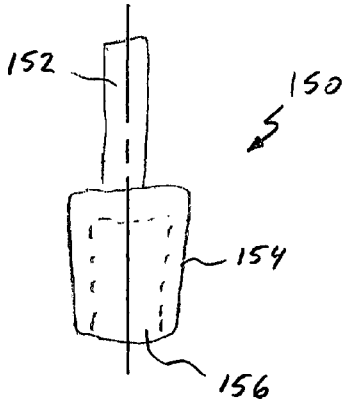
FIG. 6 is a side view in elevation of an input device used with certain embodiments of the invention.
Figure 7:
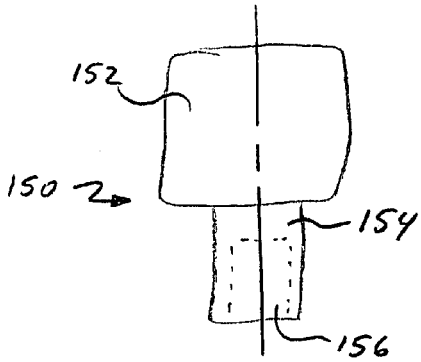
FIG. 7 is a front view in elevation of the input device of FIG. 6.

Another alternative type of user-operated override switch may be structured to control operation of the light fixture without requiring physical contact between the user and the light fixture. One such alternative override switch includes a magnetic pick-up device, or switch, disposed in-circuit to interrupt illumination cast from a light fixture responsive to user operation of a magnetic key. An operable magnetic key is illustrated generally at 150 in FIGS. 6 and 7. Key 150 includes a gripping portion 152 for holding by a user, and a stub portion 154 that holds a magnet 156. Passing the key 150 in sufficient proximity to the magnetic switch can produce an input effective to control operation of a light fixture in which the switch is installed.

Figure 8:
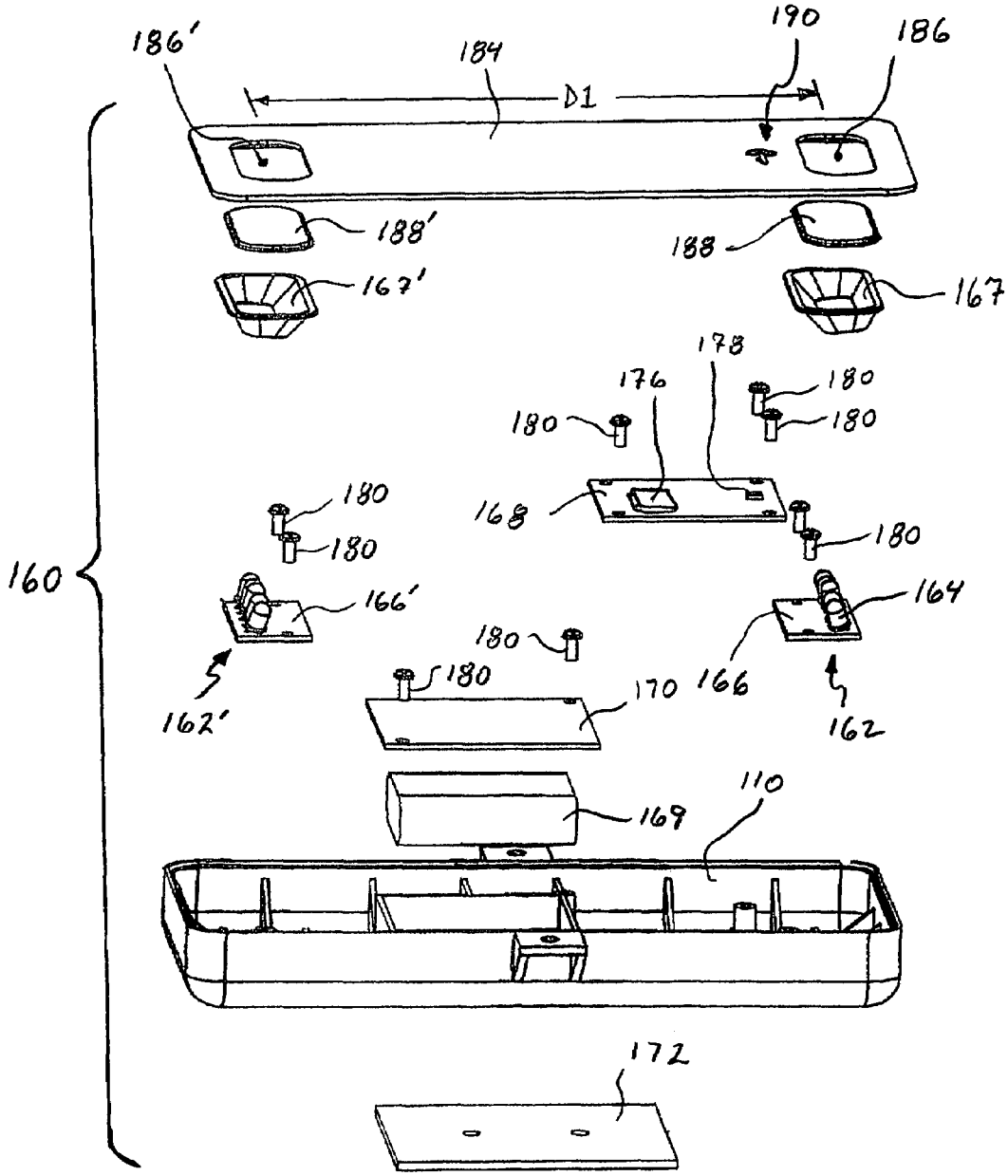
FIG. 8 is an exploded assembly view in perspective of a currently preferred embodiment constructed according to certain aspects of the invention.

FIG. 8 illustrates a currently preferred embodiment of a light fixture, generally indicated at 160. Light fixture 160 includes a housing 110 adapted to hold a first electrically powered, light-emitting element 162 disposed operably in association with housing 110 to cast illumination upon a surface of a sign or placard. As illustrated, light-emitting element 162 includes one or more LED 164 carried on a daughter board 166. The illustrated LEDs are tilted slightly with respect to a perpendicular from the daughter board so that upon installation of the daughter board, the LEDs inherently direct their illumination at an angle to better illuminate a target area of a sign. A reflector 167 may also be included to assist in defining illumination characteristics and scope of the illuminated area. The illustrated reflector 167 can be anchored in an association with the daughter board 166. Desirably, and for cost-effective manufacturing, daughterboard 166 and motherboard 168 are configured and arranged so that their installation in housing 110 automatically places them operably in-circuit.

Housing 110 also is adapted to hold a rechargeable energy storage device 169, which typically encompasses a battery or battery pack. As illustrated, a cover panel 170 may be provided to anchor the battery or battery pack 169 with respect to the housing 110. Again, for cost-effective manufacturing, battery 169 desirably is placed in-circuit for recharging by a charging device, such as by solar panel 172, upon assembly of those components in a light fixture 160.

The illustrated motherboard 168 carries a microprocessor 176 and a magnetic pick-up device 178 that are disposed in-circuit effective to control operation of the light fixture 160. A workable magnetic pick-up device includes a hall sensor, such as one of an Allegro Magnetic hall sensor, A3212, A3213 or A2314. Such components are commercially available from Allegro MicroSystems, Inc., having a place of business located at 115 Northeast Cutoff, Worcester, Mass. 01606 USA.

Illustrated microprocessor 176 is associated with a memory into which can be loaded a computer program effective to control operation of the light fixture 160. One example of a workable microprocessor 176 is commercially available from the Atmel Corporation, having a corporate headquarters in San Jose, Calif. A currently preferred microprocessor includes either of the Atmel ATtiny11 or ATtiny12 microcontrollers. Technical specifications may be found at http://www.atmel.com/dyn/resources/prod documents/1006s.pdf. Such microcontrollers include 1 kByte of flash memory. Operable microprocessors may nonexclusively include one or more of a: microprocessor, microcontroller, programmable logic controller (PLC), programmable logic unit, logic circuits, comparators, and the like. The presence of microprocessor 176 simplifies the control circuitry components by eliminating need for a photoelectric eye to control turning the light fixture on. In combination, an output from the solar panel 120 and the microprocessor may be used as a photoelectric element equivalent to a photoelectric eye 124. The equivalent combination is operable to control turning the light fixture on, or off, subsequent to illumination in the vicinity of the light fixture 160 either dropping below, or rising above, a threshold value.

Microprocessor 176 also desirably provides a certain flexibility in creating certain operational characteristics of a light fixture. As a first nonlimiting example, a first time increment may be included in the computer control program to delay energizing an LED, subsequent to illumination in the vicinity of the light fixture 160 dropping below a threshold value, until expiration of the first time increment. In certain instances, such first time increment may be a value that is selected and input by a user. In other instances, such first time increment may be preset during manufacture of a light fixture.

As a second nonlimiting example of providing flexibility in operational characteristics, the microprocessor 176 may be programmed to receive a user input (such as an arming input to place the fixture into an operational mode for autonomous operation to illuminate a sign). Desirably, placing a light fixture into operational mode may consequently initiate a self-diagnostic routine by the light fixture. One self-diagnostic routine within contemplation encompasses verification of integrity of the control circuitry and operational status of certain components. Subsequent to evaluation of the diagnostic test results, the microprocessor can be programmed to cause a humanly perceptible output to indicate such results. One output can be one or more visible flash of light from a light emitting element. Other indicating outputs may nonexclusively be embodied as tactile or audible outputs.

As a third nonlimiting example of providing flexibility in operational characteristics, a charge threshold value may be established as a program variable that is compared by a microprocessor 176 to an output from the charging device 120. The charge threshold value can be a fixed or programmable value that can even be established by a user's input, as desired. The microprocessor 176 may be programmed to ensure that a rise in the output from the charging device 120 above the charge threshold value is not caused by a source of stray light to undesirably turn off the light fixture. Stray light could come from various sources, such as a passing automobile, or a temporarily enabled porch light. One way to ensure undesirable shut down of a light fixture does not occur in error is to include a time delay as a programmed step before de-energizing the light-emitting element 162.

As a fourth and further nonlimiting example of providing flexibility in operational characteristics, a microprocessor can be programmed to manage and improve battery life, and/or control the illumination output of a light fixture. One or more of several battery-related variables can be monitored by a processor 176 and may provide control feedback to optimize battery life. Such variables nonexclusively include: charging current input to the battery, and current or voltage output of the battery during operation of a light-emitting element. The microprocessor can be programmed to enable circuit elements to urge the charging current toward a uniform or desired effective value. Similarly, the microprocessor can be programmed to control a current output or voltage output from the battery to extend a period of operation of the light element (e.g. the processor can enable elements in-circuit effective to cause a step change in battery output voltage to a sub-maximum value, or to produce a substantially sub-maximum, but constant-current, source for the light-emitting element).

Desirably, a light fixture, such as light fixture 160, includes a control-receiving device disposed in-circuit effective to provide an input to the microprocessor 176. Control-receiving devices within contemplation include the previously mentioned Hall-effect sensor and electric switch arrangements, as well as various structures that are adapted for receiving programming instructions for the microprocessor 176. Such structures may include, as a nonlimiting example, a USB or other connector to permit upgrading or changing the program stored in the flash memory associated with the microprocessor 176.

A plurality of fasteners 180 may be employed to secure the various components in an assembled position with respect to the housing 110 of a light fixture. Such fasteners 180 are illustrated in FIG. 8 as threaded fasteners of a well-known type, although other fasteners and known attachment structures, nonexclusively including heat staking; conventional, solvent, and friction welds; rivets; and adhesives, may alternatively be used without departing from the spirit of the instant invention.

It is generally preferred to enclose housing 110 to resist environmentally induced degradation of the light fixture, such as by contact between certain internal components and water. A light fixture 160 used to illuminated a yard-mounted real estate sign desirably is weather- and sprinkler-resistant. FIG. 8 illustrates a cover panel 184 that may be employed to at least substantially seal a housing 110. Illustrated cover panel 184 is opaque, to obscure visual observation of the interior of housing 110 and its contents, and to provide a pleasing appearance to light fixture 160. Because illustrated panel 184 is opaque, an aperture 186 is provided through which illumination from light-emitting element 162 may pass. A transparent lense 188 may be disposed to seal the aperture 186.

When a pair of light-emitting elements 162, 162' are included in a fixture 160, a cooperating aperture 186' is provided for second light-emitting element 162'. The plurality of apertures 186, 186' are desirably spaced apart by a distance D1 sufficient to permit the light-emitting elements 162, 162' to illuminate opposite sides of a sign. It should be noted that, for purpose of this disclosure, a "prime" is sometimes used in combination with designating numerals to distinguish between certain first and second duplications of equivalent structure, such as an aperture or light-emitting element. When cover panel 184 is embodied as an uninterrupted transparent element, distance D1 would correspond to a spacing between light-emitting elements 162, 162'. In certain embodiments of light fixtures adapted to illuminate both sides of a yard-mounted real estate sign, distance D1 is about 6 inches. However, it is within contemplation that distance D1 could range between about 2 inches, or less, and several feet, or even more, depending upon the structural details associated with a particular application.

Also, with continued reference to FIG. 8, it is desirable to provide a visual indicator, such as the key-shaped indicia indicated generally at 190, to assist a user in determining the location of the magnetic pick-up or switch 178. Therefore, a user can better know where to apply an input command, such as by sweeping the magnetic key 150 in proximity to the indicia 190. Depending upon certain details of construction of a light fixture and the relative strength of a magnet 178, the key 150 does not necessarily have to come into contact with either the housing 110 or cover panel 184. A corresponding indicia may also be included on a surface of gripping portion 152, or otherwise associated with the key 150, as a further indication to prompt a user to apply the key in effective proximity to the indicia 190.

Figure 9:
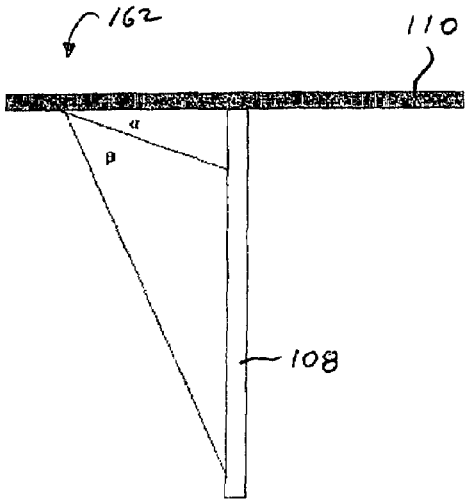
FIGS. 9 through 11 illustrate desirable illumination characteristics of preferred light-emitting elements.
Figure 10:
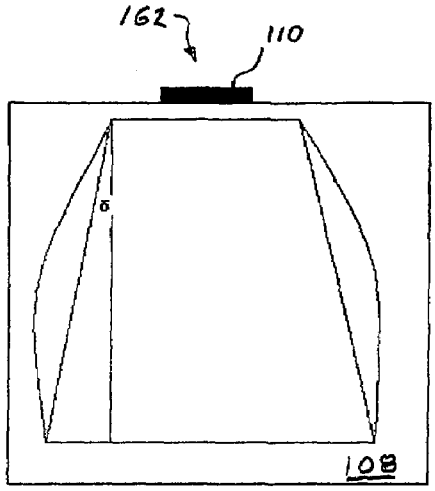
Figure 11:
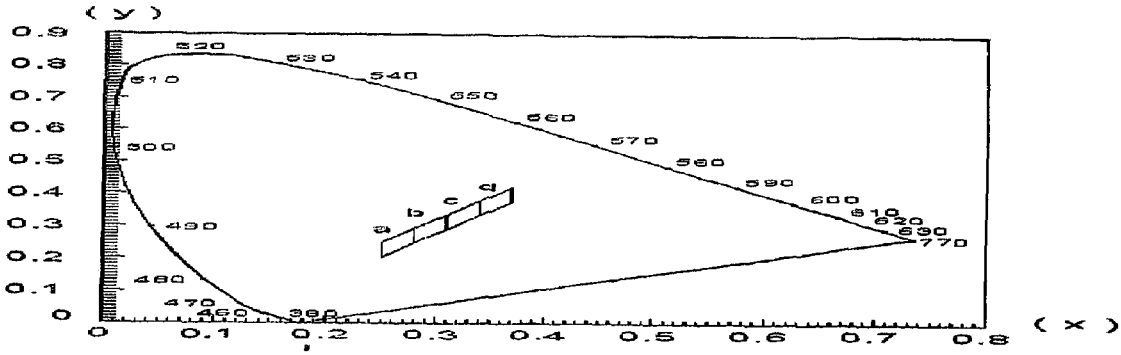

FIGS. 9-11 illustrate certain desirable operational characteristics of a light-emitting element 162 operable for use in a light fixture, such as light fixture 160, to illuminate a yard-mounted real estate sign. The angles $\alpha$ and $\beta$ are desirably about 30 degrees and 80 degrees, respectively, or may be alternative values that are selected effective to cast sufficient illumination from top to bottom of a placard 108. Angle $\gamma$ is desirably about 24 degrees, or so, or may be an alternative value that is selected effective to cast sufficient illumination from side-to-side of the placard 108. It is currently preferred to use LED light-emitting elements having a cool white color, with a luminance intensity between about 4700 and about 8000 mcd, with a typical value being about 6100. Furthermore, a desirable LED may have a viewing angle of about 30 degrees, and/or a color temperature range B in a, b, and c selected from FIG. 11.

Figure 12:
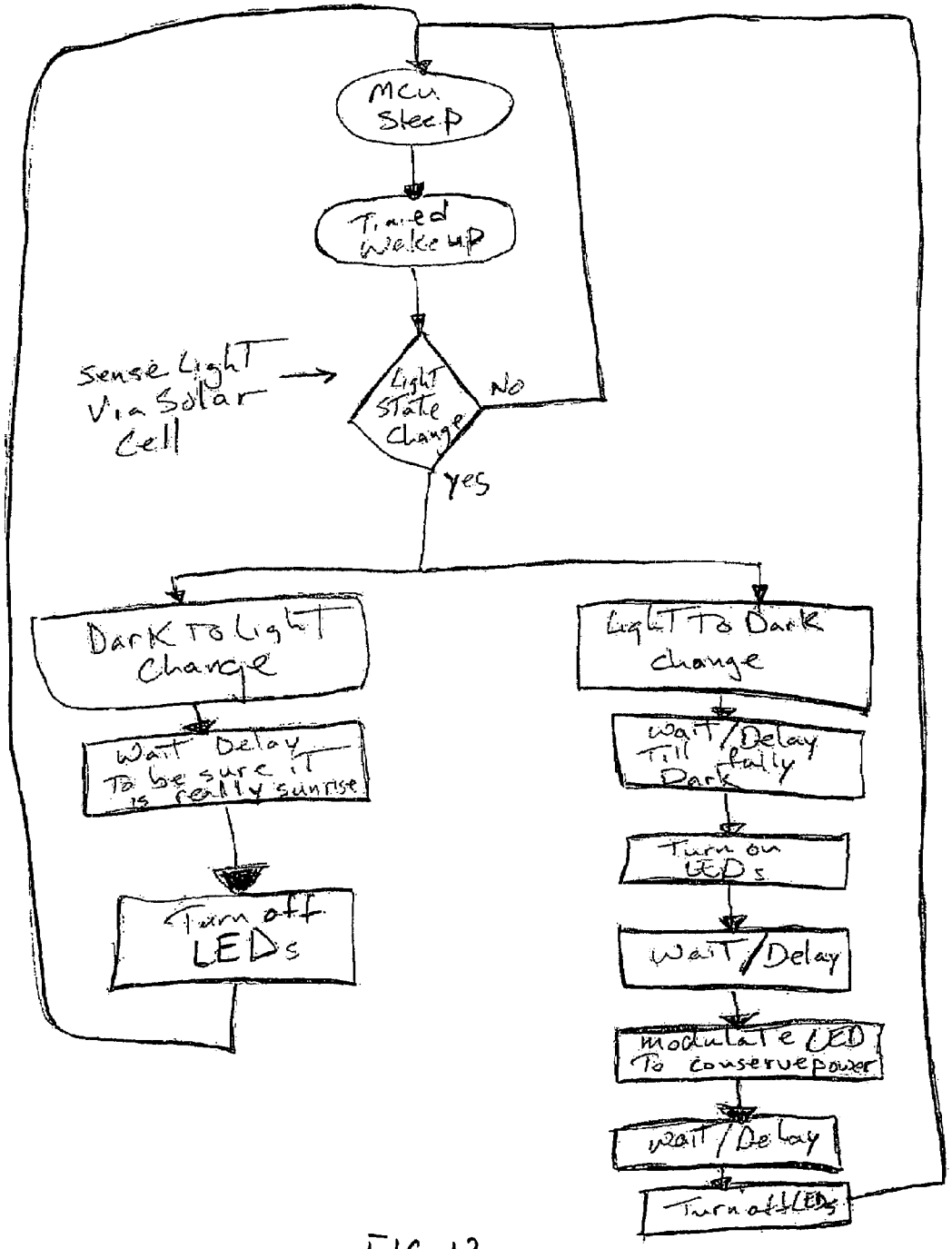
FIG. 12 is a flow chart illustrating certain steps of a program that may be used to control the embodiment of FIG. 8.

FIG. 12 illustrates certain logical steps of a computerized control program for use in a currently preferred embodiment of a light fixture 160. As outlined in one loop, the microprocessor enables verification that a change in light is really due to sunrise, and not stray light. Another program loop is adapted to permit control of light output, e.g. to manage battery life, or to cause a relatively uniform illumination for an extended period of time, etc. In one contemplated arrangement, the illumination can be maintained at a relatively constant level for a first period of time by causing a submaximum voltage from the battery pack to the light-emitting elements. For example, the output voltage from the battery pack to a light-emitting element may be set to a first reduced value, such as 80% of a fully charged or maximum voltage, for a first time period of light fixture operation. Then, for a second time period of operation, the output voltage from the battery pack to a light-emitting element may be set to a second, further reduced value, such as 50% of the fully charged value.

Figure 13:
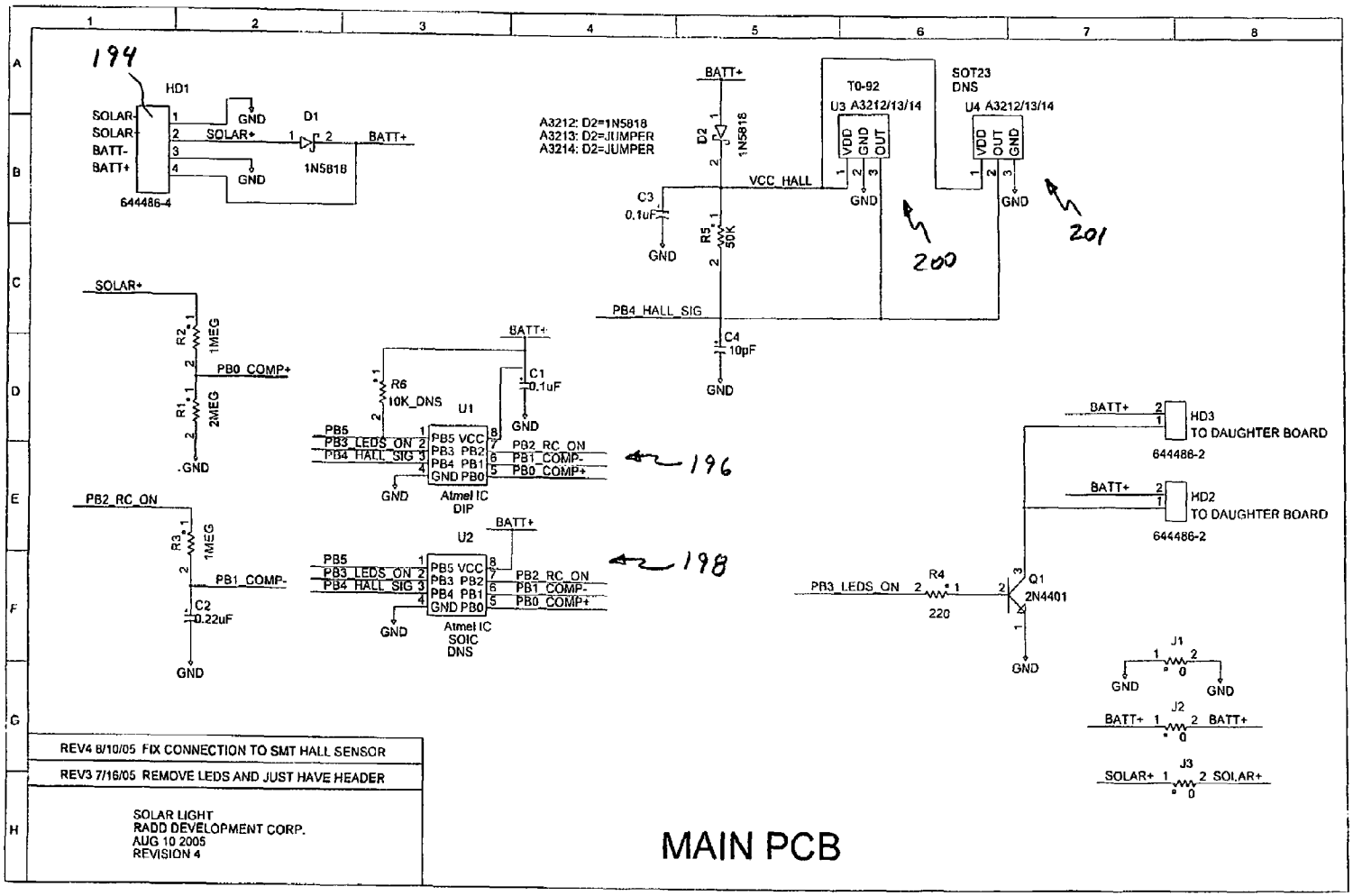
FIG. 13 is an electrical schematic illustrating certain details of construction for a motherboard used in the embodiment of FIG. 8.
Figure 14:
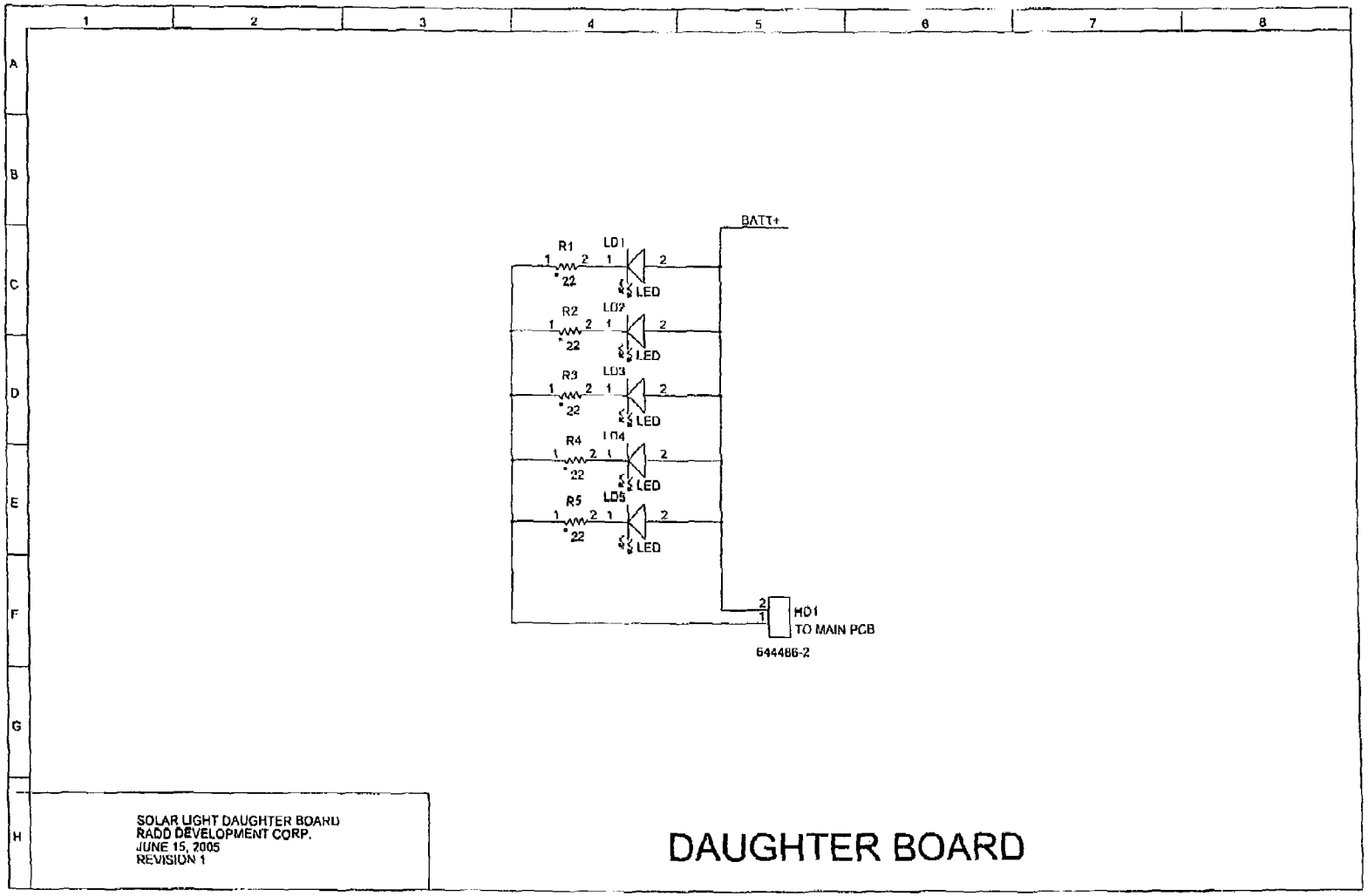
FIG. 14 is an electrical schematic illustrating certain details of construction for a daughterboard used in the embodiment of FIG. 8.

FIG. 13 outlines a workable manufacturing arrangement for certain electrical components carried by a motherboard 168 used in the currently preferred light fixture 160. Connector 194 is one example of a convenient structure to link the motherboard with the solar panel 120 and battery pack 169. The illustrations indicated generally at 196 and 198 depict wiring configurations for alternate microprocessors, respectively. Similar alternate wiring configurations for different Hall-effect sensors are indicated at 200 and 202, respectively. FIG. 14 illustrates configuration details for one workable arrangement of a daughterboard 166.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a solar-rechargeable light fixture operable to illuminate both sides of a sign depending below, and in a plane parallel to a plane passing through a length axis of, a substantially horizontal cross-bar of a residential, yard-mounted, real estate sign holder, said cross-bar comprising a width, transverse to said length axis, wherein:

said light fixture comprises:

a prismatic housing defined by walls arranged to define a substantially enclosed volume between a top and a bottom, said bottom being configured for anchoring on top of said cross-bar, and arranged to dispose substantially the entire enclosed volume above said top of said cross-bar;

a first LED carried by said housing to project in a first direction, parallel to said width, by a distance sufficient to overhang beyond an edge of said cross-bar effective to cast illumination in a straight line past said cross-bar and onto one side of said sign, said first LED being encircled by a first reflective wall configured to urge illumination from said first LED in a direction toward said sign;

a second LED carried by said housing to project in a second direction, parallel to said width, by a distance sufficient to overhang beyond an edge of said cross-bar effective to cast illumination in a straight line past said cross-bar and onto the other side of said sign, said second LED being encircled by a second reflective wall configured to urge illumination from said second LED in a direction toward said sign;

a mounting member comprising a foot transversely projecting from a central portion of a wall of said housing, said foot encompassing a through-hole structured to permit fastening said housing to said cross-bar;

a charging device adapted to convert radiation to electrical energy, said charging device being carried by said housing operably to expose said charging device to radiation from the sun;

a rechargeable energy storage device disposed in said housing and in-circuit to permit electrical communication between said energy storage device and said charging device to urge said energy storage device toward an electrically charged condition, and to permit electrical communication between said energy storage device and said first LED and said second LED;

a microprocessor disposed in-circuit to control illumination output of said light fixture;

a magnetic pick-up device associated with said microprocessor effective to provide a control input to said microprocessor; and an override switch comprising a normally open contact that is maintained in a closed position by structure anchoring said housing on said cross-bar.

* * * * *